US005759733A

United States Patent [19]

Tsubuko et al.

[11] Patent Number: 5,759,733

[45] Date of Patent: Jun. 2, 1998

[54] LIQUID DEVELOPER FOR ELECTROSTATIC ELECTROPHOTOGRAPHY

[75] Inventors: Kazuo Tsubuko; Shinichi Kuramoto, both of Numazu; Toshiki Nanya, Mishima; Kazuhiko Umemura, Susono; Kayoko Nagai, Numazu, all of Japan

[73] Assignee: Ricoh Company, Ltd., Tokyo, Japan

[21] Appl. No.: 821,314

[22] Filed: Jan. 13, 1992

Related U.S. Application Data

[63] Continuation of Ser. No. 276,169, Nov. 23, 1988, abandoned.

[30] Foreign Application Priority Data

Nov. 28, 1987 [JP] Japan ..... 62-301276

[51] Int. Cl.[6] ..... G03G 9/13; G03G 9/135

[52] U.S. Cl. ..... 430/115; 430/114

[58] Field of Search ..... 430/112, 114, 430/115

[56] References Cited

U.S. PATENT DOCUMENTS

| | | | |
|---|---|---|---|
| 3,853,554 | 12/1974 | Maki et al. | 430/112 |
| 4,259,426 | 3/1981 | Hasegawa et al. | 430/111 X |
| 4,425,418 | 1/1984 | Iwaki et al. | 430/106 |
| 4,504,563 | 3/1985 | Tanaka et al. | 430/904 X |
| 4,520,090 | 5/1985 | Yamazaki et al. | 430/138 X |
| 4,535,049 | 8/1985 | Honda et al. | 430/137 |
| 4,737,432 | 4/1988 | Tanaka et al. | 430/115 X |
| 4,772,528 | 9/1988 | Larson et al. | 430/115 |
| 4,798,778 | 1/1989 | El-Sayed et al. | 430/115 |
| 4,810,612 | 3/1989 | Ueda et al. | 430/109 |
| 4,842,972 | 6/1989 | Tavernier et al. | 430/117 |
| 4,855,207 | 8/1989 | Tsubuko et al. | 430/109 |
| 4,966,825 | 10/1990 | Suzuki et al. | 430/115 X |

FOREIGN PATENT DOCUMENTS

| | | | |
|---|---|---|---|
| 9087403 | 5/1984 | Japan | G03G 9/12 |
| 2047650 | 2/1987 | Japan | 430/114 |

*Primary Examiner*—Roland Martin

*Attorney, Agent, or Firm*—Flynn, Thiel, Boutell & Tanis, P.C.

[57] ABSTRACT

A liquid developer for use in electrophotography is disclosed, which comprises (i) a toner comprising as the main toner components a colorant, a resin, and a polyolefin resin having an acid value of from 5 to 50 and a melt viscosity at 200° C. of from 100 to 15,000 cps, and (ii) a carrier liquid in which the toner is dispersed. The polyolefin resin and the colorant in the liquid developer may constitute an integral flushing colorant which is prepared by subjecting the resin and the colorant to flushing processing.

6 Claims, No Drawings

LIQUID DEVELOPER FOR ELECTROSTATIC ELECTROPHOTOGRAPHY

This application is a continuation of U.S. application Ser. No. 07/276,169, filed Nov. 23, 1988, now abandoned.

BACKGROUND OF THE INVENTION

This invention relates to a liquid developer for use in electrostatic electrophotography, electrostatic recording, electrostatic printing and the like.

Hitherto, the following toner image fixing methods have been proposed: (1) a thermal image fixing method using an oven, in which a toner images bearing sheet is passed through the atmosphere in the oven heated by an electric heater, whereby the toner images are thermally fixed to the sheet; (2) a thermal image fixing method using heat application rollers, in which a toner images bearing sheet is passed between a pair of rollers, with at least one of the rollers being a heating roller, whereby the toner images are thermally fixed to the sheet; and (3) a pressure-application image fixing method using rigid rollers, in which a toner images bearing sheet is passed between a pair of rigid rollers at room temperature, whereby the toner images are fixed to the sheet with application of pressure thereto.

These toner image fixing methods have both merits and demerits. The above described method (2) using heat application rollers is particularly favorably adaptable to an image formation apparatus which is designed for high-speed copying. This is because the heat application roller is brought into pressure contact with the surface of a transfer sheet which bears toner images, so that the toner images are quickly and firmly fixed to the transfer sheet with high thermal efficiency. Therefore, the method (2) is currently taking the place of the above described method (1), which has long been used on most copying machines employing liquid developers.

The method (2), however, has the shortcoming that it tends to give rise to a so-called "off-set phenomenon" that when an image fixing heating roller is brought into pressure contact with a toner image bearing transfer sheet, part of the hot, melted toner on the transfer sheet is transferred to the surface of the heating roller, and the thus transferred toner is disadvantageously re-transferred to the transfer sheet and stains the same or forms a so-called ghost image on the transfer sheet.

SUMMARY OF THE INVENTION

It is therefore an object of the present invention to provide an improved liquid developer for use in electrophotography which does not give rise to the so-called off-set phenomenon even when toner images are fixed by using heat application rollers, and allows high speed image fixing with high thermal efficiency at relatively low temperatures by thermal image fixing.

Another object of the present invention is to provide a liquid developer for use in electrophotography which has an excellent toner image fixing property.

A further object of the present invention is to provide a liquid developer for use in electrophotography which has a high dispersion stability.

The above objects of the present invention can be attained by a developer which comprises (i) a toner comprising as the main components a colorant, a resin, and a polyolefin resin, and (ii) a carrier liquid of an aliphatic hydrocarbon, in which the toner is dispersed. The polyolefin resin contained in the toner may be polyolefins or polyolefin copolymers which have an acid value of from 5 to 50 and a melt viscosity at 200° C. of from 100 cps to 15,000 cps, and the colorant and the polyolefin resin may constitute an integral toner component prepared by subjecting the colorant and the polyolefin resin to a flushing process, which is referred to as the flushing colorant.

DETAILED DESCRIPTION AND THE PREFERRED EMBODIMENTS

When toner images are thermally fixed by using the conventional liquid developers (wet-type toners), toner particles are dissolved or swollen in a carrier liquid to some extent, and when this takes place, the cohesive force of a toner layer decreases. The decrease of the cohesive force gives rise to a so-called "hot off-set phenomenon". Further, the melted toner tends to stick to the surfaces of metallic heating rollers.

In the case where dry-type developers (dry-type toners) are used, melted toners can be prevented from adhering to the heating rollers by coating a silicone oil on the surfaces of the heating rollers or by using heating rollers made of Teflon. However, these methods are not suitable for a copying process in which a liquid developer is employed because the liquid developer generally contains a carrier liquid.

A liquid developer for use in electrophotography of the present invention comprises (i) a toner comprising as the main components a colorant, a resin, and a polyolefin resin, and (ii) a carrier liquid which is an aliphatic hydrocarbon solvent, in which the toner is dispersed. When necessary, a polarity controlling agent may also be added to the liquid developer.

As mentioned previously, the polyolefin resin may be polyolefins or polyolefin copolymers which have an acid value of from 5 to 50 and a melt viscosity at 200° C. of from 100 to 15,000 cps, and the colorant and the polyolefin resin may constitute an integral toner component for the toner according to the present invention, which is prepared by subjecting the colorant and the polyolefin resin to a flushing process, which toner compound is referred to as a flushing colorant.

In the case where the toner in the liquid developer comprises a polyolefin resin having an acid value of less than 5, the toner does not show sufficient adhesiveness, so that the toner images cannot be firmly fixed to a transfer sheet. On the other hand, when the toner comprises a polyolefin resin having an acid value of more than 50, the toner particles coagulate when preserved at high temperatures, thus the preservability of the toner decreases.

Further, when a polyolefin having a melt viscosity at 200° C. of below 100 cps is used, the toner layer permeates through a transfer sheet to the reverse side upon application of heat thereto, so that the resulting images are fixed to both sides of the transfer sheet and become illegible. In addition, since such polyolefins imparts insufficient adhesion between toner particles, the fixing performance of the toner layer decreases. On the contrary, if a polyolefin having a melt viscosity at 200° C. of more than 15,000 cps is employed, the toner cannot easily be melted upon application of heat. Therefore, it is difficult to fix toner images to a transfer sheet at low temperatures, for example, at 100° C. to 140° C., or at high speeds.

More specifically, however, when the image fixing temperature has to be raised to 160° C. to 210° C., and Isopar solvents which are conventionally employed as carrier liquids for wet type developers and have boiling points ranging From 150° C. to 210° C. are used at such high temperatures, such solvents evaporate or have the risk of catching fire, and the odor of the solvents spreads. High temperature image fixing has not only the above-mentioned problems, but also other problems that the image transfer sheet tends to be wound around a heat application image fixing roller, curls, changes in size, and that image fixing rollers, which are usually made of silicon rubber, acrylonitrile rubber, fluorine-containing rubber, are deteriorated while in use.

By contrast, the developer according to the present invention can be used at a fixing temperature ranging from 100° C. to 140° C., so that the above-mentioned problems are avoided.

Examples of the polyolefins or polyolefin copolymers which are usable in the present invention are polyethylene oxide, ethylene-vinylpyridine-maleic acid copolymer, ethylene-ethylacrylate-acrylic acid copolymer, ethylene-isobutylmethacrylate-acrylic acid copolymer, propylene-acrylic acid copolymer, ethylene-methacrylic acid copolymer, ethylene-glycidylmethacrylate-maleic acid copolymer, propylene-maleic anhydride copolymer, ethylene-divinylbenzene-maleic acid copolymer, isobutylene-acrylic acid copolymer, ethylene-maleic anhydride copolymer, ethylene-ethylacrylate-maleic anhydride copolymer, isobutylene-glycidyl-methacrylate-fumaric acid copolymer, and propylene-butylacrylate-itaconic acid copolymer.

Specific examples of the polyolefins and polyolefin copolymers are shown in Table 1. In the table, parenthesized numeral values shown after the names of copolymers represent the weight ratio (wt. %) of each component of the copolymers.

TABLE 1

| | Polyolefins or Polyolefin Copolymers | Melt viscosity at 200° C. (cps) | Acid Value |
|---|---|---|---|
| (1) | Ethylene-vinylpyridine-maleic acid copolymer (90/5/5) | 520 | 26 |
| (2) | Ethylene-ethylacrylate-acrylic acid copolymer (90/5/5) | 10000 | 23 |
| (3) | Ethylene-isobutylmethacrylate-acrylic acid copolymer (40/45/15) | 11000 | 48 |
| (4) | Propylene-acrylic acid copolymer (95/5) | 710 | 21 |
| (5) | Polyethylene oxide | 360 | 18 |
| (6) | Polyethylene oxide | 550 | 25 |
| (7) | Polypropylene oxide | 470 | 18 |
| (8) | Polypropylene oxide | 580 | 27 |
| (9) | Ethylene-methacrylic acid copolymer (95/5) | 12300 | 26 |
| (10) | Ethylene-glycidylmethacrylate-maleic acid copolymer (80/15/5) | 695 | 24 |
| (11) | Propylene-maleic anhydride (98/2) | 580 | 5.8 |
| (12) | Ethylene-divinylbenzene-maleic acid copolymer (90/3/7) | 865 | 46 |
| (13) | Isobutylene-acrylic acid copolymer (96/4) | 13000 | 18 |
| (14) | Ethylene-maleic anhydride copolymer (98/2) | 8900 | 24 |
| (15) | Ethylene-ethylacrylate-maleic anhydride copolymer (90/7/3) | 12500 | 28 |
| (16) | Isobutylene-glycidyl-methacrylate-fumaric acid copolymer (90/6/4) | 9600 | 15 |
| (17) | Propylene-butylacrylate-itaconic acid copolymer (85/13/2) | 1200 | 12 |

Examples of inorganic pigments used as the colorant include carbon black pigments such as furnace black, acetylene black, channel black, commercially available PRINTEX G, PRINTEX V, SPECIAL BLACK 15, SPECIAL BLACK 4, SPECIAL BLACK 4-B (made by Degussa Japan Co., Ltd.), MITSUBISHI #4, MITSUBISHI #30, MA-11, MA-100 (made by Mitsubishi Carbon Co.), RABEN 30, RABEN 40, CONDUCTEX SC (made by Columbia Carbon Ltd.), REGAL 400, REGAL 660, REGAL 800, BLACKPEARLS L (made by Cabot Co., Ltd.). In addition, inorganic white pigments such as zinc oxide, titanium oxide and silicone oxide can also be employed.

Examples of organic pigments used as the colorant include Phthalocyanine Blue, Phthalocyanine Green, Rhodamine Lake, Malachite Green Lake, Methyl Violet Lake, Peacock Blue Lake, Naphtol Green B, Permanent Red 4R, Hansa Yellow, Benzidine Yellow and Thioindigo Red.

The above listed inorganic and organic pigments are usable singly or in combination.

The aforementioned polyolefins or copolymers thereof which have an acid value of from 5 to 50, preferably from 10 to 30, and a melt viscosity at 200° C. of from 100 to 15,000 cps, preferably from 500 to 10,000 cps, are usable as a binder resin by which the pigment particles are coated. In combination with the above specified polyolefins and polyolefin copolymers, other polyolefins, acryl resins, rosin modified resins, styrene-butadiene resins, natural resins, paraffin waxes and other resins may be employed, so long as the achievement of the objects of the present invention is not impeded.

A preferable amount of the above specified polyolefins or copolymers thereof, which have a melt viscosity at 200° C. of from 100 to 15,000 cps and an acid value of from 5 to 50, is from 10 to 90 wt. % based on the total amount of the binder resins contained in the toner. Even when a flushing colorant, which will be explained in detail later, is used, the above range of the amount is also applicable.

Examples of the above described paraffin waxes and polyolefins usable in the present invention are as follows.

TABLE 2

| Manufacturers | Trademarks | Softening Point (°C.) |
|---|---|---|
| Allied Chemical Corp. | AC Polyethylene 1702 | 85 |
| | AC Polyethylene 617, 617A | 102 |
| | AC Polyethylene 9, 9A | 117 |
| | AC Polyethylene 430 | 60 |
| | AC Polyethylene 405 | 96 |
| | AC Polyethylene 401 | 102 |
| | AC Polyethylene 540 | 108 |
| | AC Polyethylene 580 | 108 |
| Kodak Japan K.K. | Epolene N-14 | 105 |
| | Epolene E-15 | 96 |
| Sanyo Chemical Industries, Ltd. | Sanwax 131-P | 108 |
| | Sanwax 151-P | 107 |
| | Sanwax 161-P | 111 |
| | Sanwax 165-P | 107 |
| | Sanwax 171-P | 105 |
| | Sanwax E-250P | 102 |
| | Sanwax E-300P | 98 |
| Junsei Chemical Co., Ltd. | Paraffin Wax | 40–90 |
| Hoechst A.G. | PED 521 | 104 |
| | PED 543 | 110 |
| | PED 153 | 99 |
| Yasuhara Yushi Kogyo Co., Ltd. | Neowax L | 105 |
| | Neowax E | 100 |

Preferable examples of the carrier liquid for use in the present invention, which is an aliphatic hydrocarbon solvent, include isododecane, n-hexane and the like, and Shellsol 71 commercially available from Shell Kagaku K. K., and Isopar G, Isopar H, Isopar E, Isopar L and Isopar K commercially available from Exxon Chemical Co., Ltd.

The liquid developer of the present invention may be prepared in accordance with the following manner:

A mixture of 1 part by weight of the colorant and from 0.3 to 3 parts by weight of the binder resin is placed in a dispersing apparatus such as an attritor, a ball mill and a Keddy mill. The mixture is well dispersed in the presence of from 10 to 20 parts by weight of an aliphatic hydrocarbon carrier liquid, thereby obtaining a concentrated toner dispersion. The thus obtained dispersion is diluted with an aliphatic hydrocarbon solvent to a volume of 5 to 10 times the initial volume of the concentrated toner dispersion.

In the above, a dispersion which comprises any of the above specified polyolefins or copolymers thereof, and an aliphatic hydrocarbon solvent can be used, as it is, as both the binder resin and the diluent. Further, when preparing the concentrated toner dispersion, resins other than the above binder resins and a polarity controlling agent such as metal soaps, lecithin, linseed oil and higher fatty acids can also be used when necessary. However, since the toner of the present invention which comprises any of the above specified polyolefins or polyolefin copolymers has high polarity and excellent dispersing stability, good results can be expected even if no polarity controlling agents are added.

Conventional inorganic and organic pigments are usable as the colorant in the present invention. However, a colorant which is prepared by a flushing method as described below is more preferable. According to the flushing method, pigment particles are pulverized into primary particles at the initial stage. The resulting colorant provides the developer with the characteristics of improved gradation, resolution and image density.

The flushing method is conducted as follows. A pigment or a pigment paste containing water is placed together with a resin solution or a resin, and well mixed in a kneader called a "flusher". In the course of this process, the water surrounding the pigment particles is substituted with the resin solution or the resin. Thereafter, the mixture is taken out from the flusher, and the water phase of the mixture is removed. The remaining resinous phase containing the pigment is dried to remove the solvent, and the resulting solid mass is crushed into a powder. The thus obtained powdery colorant is referred to, in the present invention, as a "flushing colorant", which can be used as a toner component of the toner in the developer according to the present invention. in the above flushing method, the water and the solvent can also be removed under reduced pressure while kneading the mixture. As far as the flushing method is employed, not only a pigment but also a dyestuff may be used as a component of the toner for use in the present invention. In this case, it is necessary to knead a dyestuff with water into a mud-like paste in advance. From 10 to 60 parts by weight of the pigment or dyestuff are suitably subjected to the flushing treatment together with 100 parts by weight of the resin. Further, the flushing treatment is effectively proceeded in the presence of humic acid, salts of humic acid (Na salts, $NH_4$ salts, etc.), or humic acid derivatives. The amount of the humic acid or the like is preferably from 0.1 to 30 wt. % based on the amount of the water-containing pigment or dyestuff paste.

Any resins which have been conventionally used as a binder for wet-type toners can be used in the flushing treatment. Of such resins, the above specified resins, that is, polyolefins and polyolefin copolymers which have a melt viscosity at 200° C. of from 100 to 15,000 cps and an acid value of from 5 to 50 are preferably used.

The followings are preparation examples of a flushing colorant.

Colorant Preparation Example 1

20 g of ammonium humate was dissolved in 200 g of water in a gallon kneader to prepare an aqueous solution of ammonium humate. To this solution, 250 g of carbon black (Trademark "Mitsubishi #44") was added and thoroughly dispersed. Thereafter, 750 g of an ethylene-vinylpyridine-maleic acid copolymer (90/5/5) shown as polyolefin copolymer No. (1) in Table 1 was added and mixed at an elevated temperature of about 180° C. Water was then removed from the mixture.

The resulting mixture was further kneaded at about 180° C. for 4 hours, and then subjected to vacuum drying, so that a solid mass was obtained. After cooling, the thus obtained solid mass was crushed into finely-divided particles, whereby a flushing colorant No. 1 for use in the present invention was prepared.

TABLE 3

| Flushing Colorant | Water | Humic Acid | | Pigment | | Resin | |
|---|---|---|---|---|---|---|---|
| No. 3 | 150 | Ammonium fumate | 25 g | Printex V | 300 g | Copolymer (3) in Table 1 | 200 g |
| | | | | | | PED 521 | 250 g |
| No. 4 | 150 | Ammonium fumate | 25 g | Printex V | 300 g | Copolymer (4) in Table 1 | 300 g |
| | | | | | | Sanwax 250P | 300 g |
| No. 5 | 250 | Ammonium fumate | 25 g | Regal 400 | 300 g | Copolymer (12) in Table 1 | 500 g |
| | | | | | | Bees wax | 250 g |
| No. 6 | 250 | Humic acid | 50 g | Regal 400 | 300 g | Copolymer (9) in Table 1 | 500 g |
| | | | | | | Paraffin wax (softening point 64° C.) | 200 g |
| No. 7 | 100 | Humic acid | 50 g | Phthalocyanine Blue | 250 g | Polypropylene oxide (7) in Table 1 | 300 g |
| No. 8 | 100 | Humic acid | 50 g | Phthalocyanine Green | 250 g | Polypropylene oxide (8) in Table 1 | 250 g |
| | | | | | | Sanwax 171P | 280 g |
| No. 9 | 100 | — | | Thioindigo Red | 300 g | Copolymer (9) in Table 1 | 300 g |
| No. 10 | 100 | — | | Printex G | 250 g | Copolymer (10) in Table 1 | 100 g |
| | | | | Alkali Blue | 50 g | BR-102 (acrylic resin) | 80 g |

The present invention will now be explained in more detail by referring to the following examples and comparative examples, which are given for illustration of the invention and are not intended to be limiting thereof.

EXAMPLE 1

The following components were placed in a ball mill and dispersed for 24 hours:

| | Parts by Weight |
|---|---|
| Flushing Colorant No. 1 (prepared in Colorant Preparation Example 1) | 50 |
| Isopar H 20% solution of a lauryl methacrylate/methylmethacrylate/methacrylic acid/glycidylmethacrylate (80/10/5/5) copolymer | 100 |
| Isopar H (made by EXXON Chemical Co. Ltd.) | 200 |

To the above dispersion, 300 parts by weight of Isopar H were further added and dispersed for 1 hour, so that a concentrated toner dispersion was prepared. 200 g of the thus prepared concentrated toner dispersion was diluted with 1 liter of Isopar H, whereby a liquid developer No. 1 according to the present invention was prepared.

EXAMPLE 2

Example 1 was repeated except that the dispersion for the concentrated toner dispersion employed in Example 1 was replaced by a dispersion with the following formulation, whereby a liquid developer No. 2 according to the present invention was prepared.

| | Parts by Weight |
|---|---|
| Polyethylene oxide shown as polyolefin No. (5) in Table 1 | 60 |
| Isopar H 10% solution of a stearylmethacrylate/methylmethacrylate/methacrylic acid/hydroxymethylmethacrylate (85/7/4/4) copolymer | 200 |
| Carbon black (Trademark "Mitsubishi Carbon MH-100") | 50 |
| Isopar H | 100 |

EXAMPLE 3

Example 1 was repeated except that the colorant employed in Example 1 was replaced by Flushing Colorant No. 6 prepared in Table 3, whereby a liquid developer No. 3 according to the present invention was prepared.

EXAMPLE 4

Example 1 was repeated except that the dispersion for the concentrated toner dispersion employed in Example 1 was replaced by a dispersion with the following formulation, whereby a liquid developer No. 4 according to the present invention was prepared.

| | Parts by Weight |
|---|---|
| Ethylene-methacrylic acid copolymer (95/5) shown as polyolefin copolymer No. (9) in Table 1 | 80 |
| Carbon black (Trademark "Regal 400" made by Cabot Co., Ltd.) | 30 |
| Isopar H | 200 |

COMPARATIVE EXAMPLE 1

Example 1 was repeated except that the dispersion for the concentrated toner dispersion employed in Example 1 was replaced by a dispersion with the following formulation in which no flushing colorant was employed, whereby a comparative developer No. 1 was prepared:

| | Parts by Weight |
|---|---|
| Isopar H 10% solution of a stearylmethacrylate/methylmethacrylate/methacrylic acid/hydroxymethylmethacrylate (85/7/4/4) copolymer | 260 |
| Carbon black (Trademark "Mitsubishi Carbon MH-100") | 50 |
| Isopar H | 100 |

COMPARATIVE EXAMPLES 2 to 5

Colorant Preparation Example 1 was repeated except that the ethylene-vinylpyridine-maleic acid copolymer (90/5/5) employed therein was replaced by the ethylene-vinylpyridine-maleic acid copolymers having the following ratios of the respective monomer components, whereby comparative flushing colorants A to D were prepared:

| Flushing Colorant | Monomer Ratio | Acid Value | Melt Viscosity (cp) |
|---|---|---|---|
| A | 95/5/0 | 0 | 520 |
| B | 94.5/5.25/0.25 | 2 | 520 |
| C | 77/4/19 | 60 | 520 |
| D | 72/4/24 | 100 | 520 |

Example 1 was repeated except that Flushing Colorant No. 1 employed in Example 1 was replaced by each of the above prepared comparative flushing colorants A to D, whereby Comparative Developers No. 2 to No. 5 were prepared.

In order to evaluate the toner images fixing performance and to observe the transfer of the liquid developers to a thermal toner image fixing roller, the above prepared Liquid Developers No. 1 to No. 4 according to the present invention, and Comparative Liquid Developers No. 1 to 5 were subjected to a copy making test by use of a commercially available electrophotographic copying machine (Trademark "CT 5058" made by Ricoh Company, Ltd.) with the temperature of the thermal toner image fixing roller set at 140° C., so that 100 duplex copies were made continuously. The toner image fixing ratio and the toner offset on the neat application roller were inspected in the copy making test. The results are shown in Table 4.

TABLE 4

| | Toner Image Fixing Ratio (%) | Toner Off-set on Heating Roller | Preserv-ability |
|---|---|---|---|
| Example 1 | 88.0 | Nil | Good |
| Example 2 | 79.5 | Nil | Good |
| Example 3 | 85.8 | Nil | Good |
| Example 4 | 80.0 | Nil | Good |
| Comparative Example 1 | 62.4 | Observed | Good |
| Comparative Example 2 | 68.1 | Slightly observed | Good |
| Comparative Example 3 | 62.1 | Slightly observed | Good |
| Comparative Example 4 | 90.3 | Nil | Poor |
| Comparative Example 5 | 92.2 | Nil | Poor |

In the above, the toner image fixing ratio was calculated in accordance with the following formula by subjecting the images of each copy sample to friction 100 times by use of a clock meter:

$$\text{Toner Image Fixing Ratio (\%)} = \frac{\text{Toner Image Density after friction}}{\text{Toner Image Density before friction}} \times 100$$

Toner offset on heating roller was assessed by visually inspecting the presence of ghost images which may appear on a copy paper at regular intervals of the length corresponding to the circumference of the employed heating roller.

The preservability of each developer was assessed by measuring the viscosity of each liquid developer after storage at 50° C. for 1 month. In the above table, the term "good" means that the viscosity was 200 cps or less and substantially no changes were found in the viscosity, and the term "poor" means that the viscosity increased to 1,000 cps or more, indicating a drastic change in the viscosity The above data clearly indicate that when the liquid developers of the present invention are employed, toner images can be well fixed by using thermal rollers without giving rise to the so-called off-set phenomenon.

In addition, by using the liquid developers of the present invention, toner images can be sharply fixed without causing a blur in images when the toner prepared by the flushing process was employed.

Further, when the above specified resins for use in the present invention are employed in dry-type toners as a binder, good results, almost equal to the above results, were obtained.

What is claimed is:

1. A liquid developer for use in electrophotography comprising:

a toner comprising as the main toner components a colorant and a polyethylene oxide or polypropylene oxide resin having an acid value of from 5 to 50 and a melt viscosity at 200° C. of from 100 to 15,000 cps; and an aliphatic hydrocarbon carrier liquid in which said toner is dispersed.

2. A liquid developer for use in electrophotography comprising:

a toner comprising as the main toner components a colorant, polyethylene oxide or polypropylene oxide resin having an acid value of from 5 to 50 and a melt viscosity at 200° C. of from 100 to 15,000 and a second resin different from said polyethylene oxide or polypropylene oxide resin, the amount of the polyethylene oxide or propylene oxide resin being in the range of 10 to 90 wt. % of the total of said second resin and said polyethylene oxide or polypropylene oxide resin, said second resin being selected from the group consisting of a polyolefin different from polyethylene oxide or polypropylene oxide, acrylic resin, rosin-modified resin, styrene-butadiene resin, natural resins and paraffin wax; and an aliphatic hydrocarbon carrier liquid in which said toner is dispersed.

3. The liquid developer as claimed in claim 1, wherein said polyolefin resin has an acid value of from 10 to 30 and a melt viscosity at 200° C. of 500 to 10,000 cps.

4. The liquid developer as claimed in claim 1, wherein said polyolefin resin is polyethylene oxide.

5. A liquid developer for use in electrophotography, comprising:

a toner comprising a colorant and a binder resin selected from the group consisting of polyethylene oxide and polypropylene oxide, with the provisos that said binder resin has an acid value of from 5 to 50 and a melt viscosity at 200° C. of from 100 to 15,000 cps, and a carrier liquid in which said toner is dispersed.

6. A liquid developer for use in electrophotography comprising:

a toner comprising as the main toner components a colorant and a polyolefin resin having an acid value of from 5 to 50 and a melt viscosity at 200° C. of from 100 to 15,000 cps, said polyolefin resin consisting of an ethylene-vinylpyridine-maleic acid copolymer with a respective component weight ratio of 90/5/5; and an aliphatic hydrocarbon carrier liquid in which said toner is dispersed.

* * * * *